US005156026A

United States Patent [19]

Karetnikov et al.

[11] Patent Number: 5,156,026

[45] Date of Patent: Oct. 20, 1992

[54] JIGGER APPARATUS FOR TREATMENT OF TEXTILE MATERIALS

[76] Inventors: Evgeny V. Karetnikov, ulitsa 4 Kuryanovskaya, 21, kv.5.; Sergei F. Grishin, prospekt Textilschikov, 117-B, kv.36; Valentin M. Spitsin, ulitsa 4 Volgogradskaya, 22, kv.1., all of Ivanovo, U.S.S.R.

[21] Appl. No.: 694,421

[22] Filed: May 1, 1991

[51] Int. Cl.[5] ..... D06B 23/04; D06B 23/16

[52] U.S. Cl. ..... 68/210; 68/198

[58] Field of Search ..... 68/8, 150, 180, 189, 68/198, 199, 210

[56] References Cited

U.S. PATENT DOCUMENTS

| | | | |
|---|---|---|---|
| 2,700,883 | 2/1955 | Jacobs | 68/199 X |
| 2,792,702 | 5/1957 | Newcomb et al. | 68/189 |
| 2,872,802 | 2/1959 | Bellmann | 68/150 |
| 3,596,481 | 8/1971 | Wilcox | 68/150 |
| 3,826,112 | 7/1974 | Sick | 68/150 X |

FOREIGN PATENT DOCUMENTS

| | | | |
|---|---|---|---|
| 2092190 | 8/1982 | United Kingdom | 68/180 |

*Primary Examiner*—Philip R. Coe
*Attorney, Agent, or Firm*—Ladas & Parry

[57] ABSTRACT

The jigger apparatus is used for the treatment of textile materials in sealed reservoirs under pressure and comprises a cover mounted on a base, a hollow housing movable in relation to the cover along the longitudinal axis thereof, and a frame of the housing carrying production equipment. The frame is made of two parts, the first part being connected to the cover by a hinge whose axis is horizontal and normal to vertical axial plane of the hollow housing, while the second part is provided with supporting rollers resting on longitudinal projections available inside the hollow housing and a cross arm connected to said second part of the frame by a hinge whose axis plane of the hollow housing, the supporting rollers being installed at the ends of the cross arm.

2 Claims, 1 Drawing Sheet

JIGGER APPARATUS FOR TREATMENT OF TEXTILE MATERIALS

FIELD OF THE INVENTION

This invention relates to finishing equipment of textile industry and, more particularly, to a jigger apparatus for treatment of textile materials which can be used, for example, for dyeing of fabrics under pressure, plasma chemical treatment of fabrics or their treatment in media harmful to people.

BACKGROUND OF THE INVENTION

Known in the art is a jigger apparatus used in the textile industry, which comprises a movable cover and a stationary housing accomodating production equipment.

This jigger is mainly deficient in that the production equipment is not easy to service inside the housing. This equipment has to be rolled out of the housing to a special carriage through an opened butt end of the jigger in order to load a textile material, or to clean and repair the jigger. For this reason all coupling of such a jigger to service lines (steam, vacuum pipes, electric cables, power lines, etc.) are made via connectors which should each time be joined and disconnected and checked for tightness. This makes servicing of the jigger time consuming and complicated and, consequently, its operation is made less reliable.

Also known in the art is a jigger apparatus for treatment of textile materials, comprising a base, a cover mounted fixedly on said base, a housing movable along its longitudinal axis in relation to the cover, and production equipment mounted on a frame (cf., advertising material for BX-SUPER-1200XT apparatus manufactured by Vald. Henriksen, Denmark). The production equipment in this apparatus is rigidly secured on the cover since the cover is fixedly installed on the frame. All connecting lines of the production equipment extend through the cover, the housing being without any service lines whatsoever and can be rolled away from the cover on wheels. For the heavy production equipment not to be cantilevered on the cover, the frame is provided with a pair of rollers and the housing with two longitudinal projections whereon the rollers run when the housing is displaced.

This apparatus is convenient in operation and quite widely applied. But it is deficient in that the rigid connection of the frame and production equipment to the cover and of rollers to the frame requires very precise manufacturing processes and through assembly to avoid, during the displacement of the housing, any bending loads which may be destructive to the frame-cover connection. This may be caused by manufacturing faults and errors of assembly when the planes of the housing projections do not match the path of the surfaces of rollers running on these planes. Such a mismatch makes the rollers rise with a certain effort and hang over the projections, loosening the contact therewith, which is the reason for the fracture of the frame-cover joint.

In addition, this construction also requires a thorough adjustment of the cover plane with the housing entrance in order to achieve a perfect fit for further sealing. No assembly adjustments during the operational period could guarantee such a perfect fit which can only be relied on in case every single interacting part, and there are dozens of them, has been precisely manufactured. This precision manufacturing process makes the apparatus and its operation an expensive exercise, to say nothing of the repair costs. But even with the stringent requirements for the precision of manufacturing of parts of the apparatus, bending loads cannot be eliminated and the reliability of the apparatus is affected whether it operates at room temperature or is subjected to environment variations resulting in metal expansion processes.

OBJECT AND SUMMARY OF THE INVENTION

The object of the invention is to reduce the cost of manufacturing of a jigger apparatus for treating textile materials.

Another object of this invention is to make the operation of a jigger apparatus more reliable.

These and other objects of the invention are achieved by a jigger apparatus for treatment of textile materials, comprising a cover mounted on a base, a hollow housing mounted on wheels and movable along said base along the longitudinal axis thereof in relation to the cover, a frame carrying production equipment and made of two parts, the first part connected to the cover and the second part accomodated inside the housing and provided with rollers resting on longitudinal projections arranged internally on the housing. According to the invention, the second part of the frame comprises a cross arm secured thereto by a hinge with a horizontal axis lying in a plane parallel to the vertical axial plane of the housing, while the first part of the frame is secured to the cover by a hinge whose horizontal axis is perpendicular to the vertical axial plane of the housing, the supporting rollers of the frame being mounted at the ends of the cross arm and having a toroidal supporting surface.

The cover should preferably be mounted on the base and be displaceable for adjustment in relation to this base.

The use of hinges with horizontal axes arranged in perpendicular planes, provided in units connecting parts of the frame with the cover and cross arm, permits a reliable contact of supporting rollers of the cross arm with the longitudinal projections of the housing whatever the inaccuracies of these parts due to manufacturing faults or wear after lengthy operation, said contact being achieved by turning of the frame parts in vertical and horizontal planes. The possibility of supporting rollers contacting only one longitudinal projection, which causes cantilever loads and fast wear of contacting surfaces, is totally eliminated. Since parts of the frame are movable vertically and horizontally, the contact surfaces of the hollow housing, supporting rollers, and the base on which the housing is displaced do not require a high precision manufacturing process. This permits reduction of the costs of the jigger, while making it reliable in operation and keeping the production equipment in a specific position when the housing is displaced.

The probability of accidents is substantially reduced by eliminating bending stresses in the frame-cover joint.

Installation displacement of the cover in relation to the hollow housing permits adequate adjustment even when parts of the jigger vary in dimensions within the allowance.

BRIEF DESCRIPTION OF DRAWINGS

The invention will now be described in greater detail, by way of example, with reference to the accompanying drawings wherein.

DETAILED DESCRIPTION OF THE INVENTION

Figure 1:
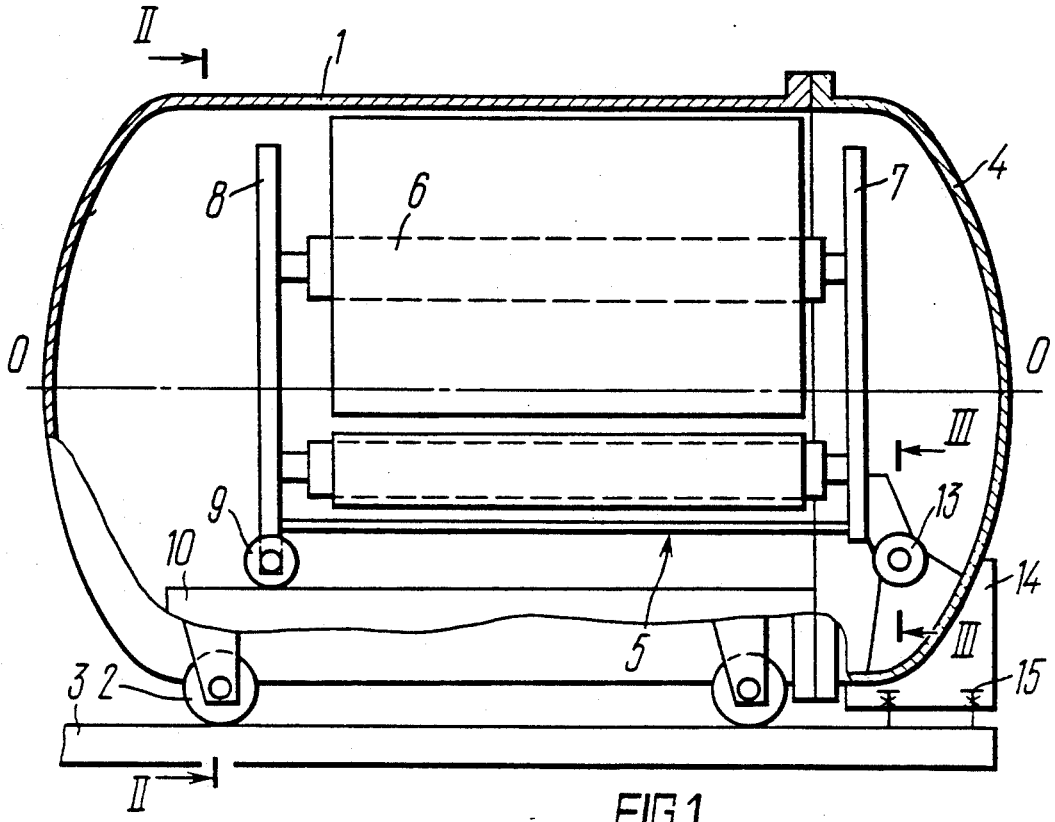
FIG. 1 shows a partial longitudinal sectional general view of a jigger apparatus for treatment of textile materials, according to the invention.

The jigger apparatus, according to the invention, for treatment of textile materials comprises a hollow housing 1 (FIG. 1) having a horizontal longitudinal axis O—O and mounted on wheels 2 movable on a base 3 along said longitudinal axis O—O in relation to a cover 4 installed on the base 3. The jigger apparatus also comprises a frame 5 consisting of two parts 7 and 8. The first part 7 of the frame 5 is secured to the cover 4, while the second part 8 is accomodated inside the hollow housing 1 and provided with supporting rollers 9 resting on longitudinal projections 10 (FIG. 2) arranged integrally in the housing 1.

Figure 2:
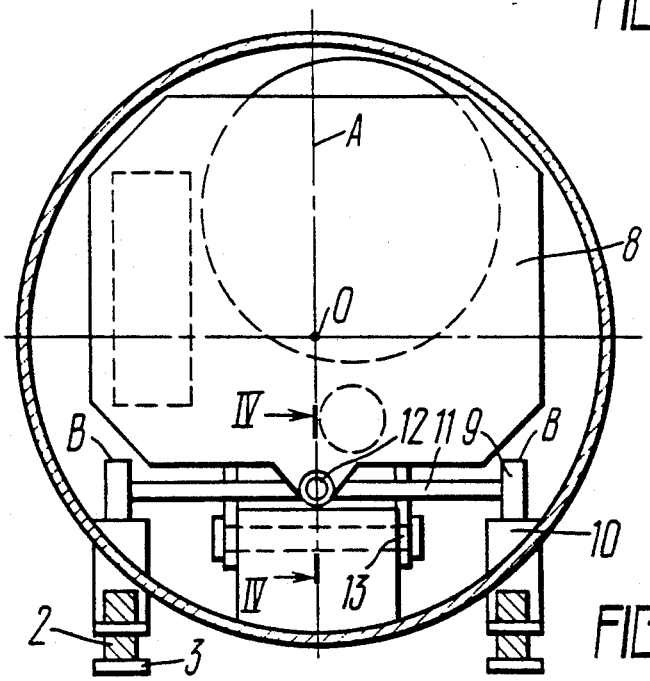
FIG. 2 shows a sectional view II—II in FIG. 1.
Figure 3:
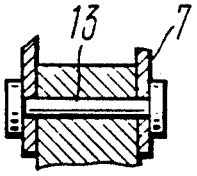
FIG. 3 shows a sectional view III—III in FIG. 1.
Figure 4:
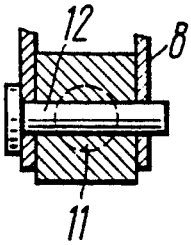
FIG. 4 shows a sectional view IV—IV in FIG. 2.

The second part 8 of the frame 5 is equipped with a cross arm 11 secured thereto by a hinge 12 whose horizontal axis is located in the vertical plane A parallel to an imaginary vertical axial plane of the housing 1 (in this case the plane A coincides with the vertical axial plane). The first part 7 (FIG. 1) of the frame 5 is secured to the cover 4 by a hinge 13 (FIG. 2) whose horizontal axis is located perpendicularly to the vertical axial plane of the housing 1, that is normally to the vertical plane A, as shown in FIG. 2. The hinges 13 and 12 are conventional and shown in FIGS. 3 and 4 respectively.

Supporting rollers 9 of the frame 5 are secured at the ends of the cross arm 11 and have a toroidal surface B, that is their surface is convex.

The cover 4 (FIG. 1) rests on the base 3 and is movable in relation to this base 3 for adjustment by means of a bracket 14 and fixing members 15 made as screw locks which makes it possible to arrange the cover 4 at any angle to the base 3 in any plane in relation to the housing 1.

The jigger apparatus for treatment of textile materials according to the invention operates as follows.

When the production process of treatment of a textile material is over in the sealed jigger, the apparatus is opened, the production medium is removed, and an instruction is issued to displace the housing 1 which moves on wheels 2 over the base 3 from the cover 4. Since the production equipment 6 is secured by a hinge 13 on the frame 5 to the stationary cover 4, it cannot move with the housing 1 and supporting rollers 9 run on the longitudinal projections 10 of the housing 1. These longitudinal projections 10 inevitably deviate from the general plane, but this does not result in jamming, bending stresses, and damages, since the cross arm 11 rotates in the hinge 12 with respect to the frame 5 and the toroidal surface of the rollers 5 retains its contact with the projections 10. Manufacturing inaccuracies in supporting rollers 9 and wheels 2 and out-of-parallel projections 10 and base 3 do not also result in any damage to the joint of the frame 5 and cover 4 because of the hinge 13 provided for the frame 5 to turn without transmitting the bending stress to the cover 4. This means that no manufacturing fault in any part of the jigger can result in extra stresses and damaged connections.

Hinges 12 and 13 make the cover 4 independent of the housing 1 and frame 5. During assembly operations, the cover 4 can be turned, in relation to the housing 1, so that the planes of separation are matched. Stringent requirements to the precision of the mutual arrangement of jigger parts are eliminated. It is enough to make the flanges of the housing 1 and cover 4 flat, which could easily be achieved by uncomplicated turning machining on a lathe. The matching of the two flanges is performed by adjustment of members 15 during assembly and is not changed further on. The housing 1 is sealed off by fastening the flange of the cover 4 to that of the housing 1 and securing members 15 in a specific position.

The herein disclosed invention permits reduction of the stringent requirements to the quality of treatment of contact surfaces of a jigger apparatus and, consequently, makes use of a much cheaper production processes (stamping instead of polishing, milling instead of scraping, etc.). Manufacturing costs may, without any loss in the quality of treatment of textile materials, be substantially reduced and jiggers can be made much cheaper and more reliable.

What is claimed is:

1. An apparatus for treatment of textile materials which comprises: a base; a cover mounted on said base; a hollow housing with a horizontal longitudinal axis, said hollow housing being mounted on wheels and being movable on the base in relation to said cover along said longitudinal axis; longitudinal projections provided internally in said hollow housing; a frame consisting of first and second parts, at least said second part of the frame being accommodated inside said hollow housing; production equipment means for treating said textile material installed on said frame; said first part of said frame being connected to said cover by a first horizontal hinge arranged normally to an imaginary vertical axial plane extending through the longitudinal axis of said hollow housing; said second part of said frame being provided with a cross arm, a second horizontal hinge being provided which connects said second part of the frame with the cross arm, said second horizontal hinge being arranged in a plane parallel to the imaginary vertical axial plane extending through the longitudinal axis of said hollow housing; rollers having a supporting surface mounted on the cross arm of said second part of the frame, the supporting surface of said rollers being toroidal and resting on said longitudinal projections of the housing.

2. An apparatus for treatment of textile materials as claimed in claim 1, wherein said apparatus comprises means for displacing the cover with respect to the base whereby the cover can be moved to a plurality of different positions with respect to the base.

* * * * *